United States Patent [19]

Cyphelly

[11] 4,411,646

[45] Oct. 25, 1983

[54] DECANTER CENTRIFUGE HAVING DIFFERENTIAL DRIVE UNIT

[76] Inventor: Ivan J. Cyphelly, Neuhaus, 8128 Hinteregg, Switzerland

[21] Appl. No.: 263,013

[22] Filed: May 12, 1981

[30] Foreign Application Priority Data

May 16, 1980 [CH] Switzerland ..... 3854/80

[51] Int. Cl.[3] ..... B04B 3/04; B04B 9/06

[52] U.S. Cl. ..... 494/53; 494/84

[58] Field of Search ..... 233/7, 19 R, 19 A, 6, 233/3, 23 R, 24; 192/61; 494/53, 54, 52, 51, 84

[56] References Cited

U.S. PATENT DOCUMENTS

| | | | |
|---|---|---|---|
| 3,734,399 | 5/1973 | Oas | 233/19 A |
| 3,896,912 | 7/1975 | Cyphelly | 192/61 |
| 3,923,241 | 12/1975 | Cyphelly | 233/7 |
| 4,073,431 | 2/1978 | Jager | 233/7 |
| 4,113,171 | 9/1978 | Cyphelly | 233/7 |
| 4,228,949 | 10/1980 | Jackson | 233/7 |
| 4,298,162 | 11/1981 | Hohne | 233/7 |

*Primary Examiner*—Robert W. Jenkins
*Attorney, Agent, or Firm*—Browdy & Neimark

[57] ABSTRACT

A decanter centrifuge has a drum driven by a main driving motor via belts and a worm gear located in the drum so that it can rotate. The worm gear is driven by a hydraulic motor with a differential rate of rotation which rotates with the drum, thus providing a slip drive unit. A hydrostatic coupling is connected between the main drive motor and the belt drive of the drum. A pressure line of the pump of the hydrostatic coupling is connected hydraulically with the feed line of the hydraulic motor of the worm gear through a flow-control valve. With this arrangement, only a single pump, that is, the pump of the hydrostatic coupling is required to accelerate the drum and regulate the rate of rotation of the drum on the one hand, and simultaneously to feed the slip drive unit, on the other.

10 Claims, 5 Drawing Figures

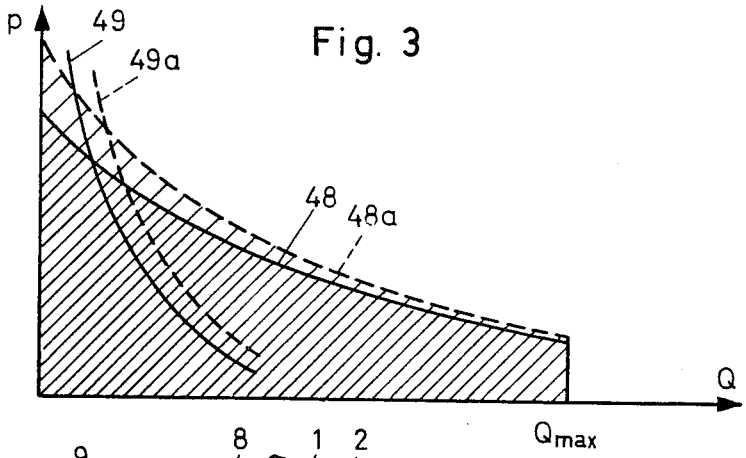
Fig. 3
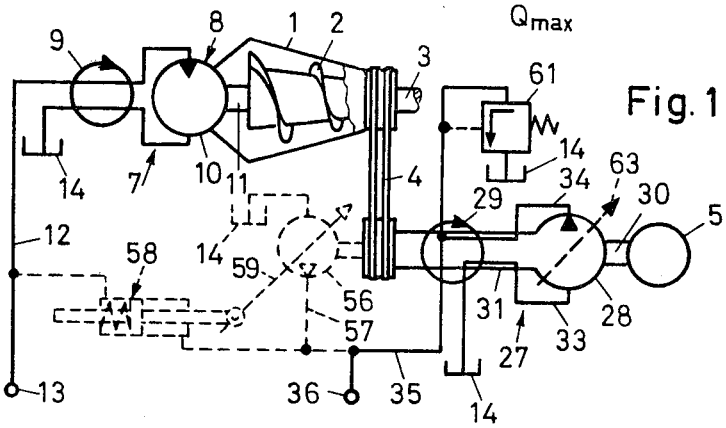
Fig. 1
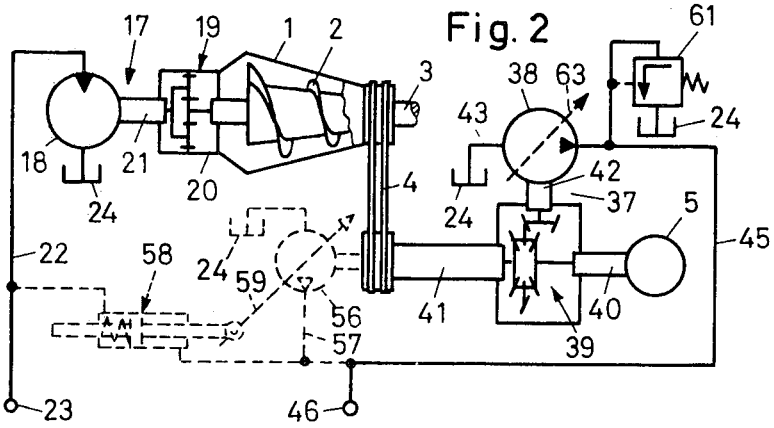
Fig. 2
Fig. 4
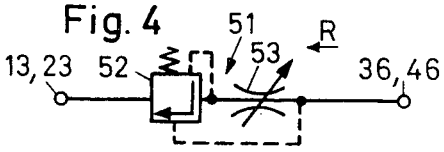
Fig. 5
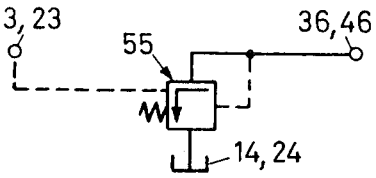

DECANTER CENTRIFUGE HAVING DIFFERENTIAL DRIVE UNIT

BACKGROUND OF THE INVENTION

This invention is concerned with a centrifuge having a drum driven by a main drive motor and having a worm gear located inside the drum. More particularly, the invention relates to such a centrifuge in which the worm gear is driven by a differential drive unit which contains a hydraulic motor and has a different rate of rotation from that of the drum.

Because of its advantageous adjustability, a hydraulic drive unit continues to prove its worth as a differential drive unit for the rotary motion between the drum and the worm gear of a decanter centrifuge. When used for this purpose, a hydraulic drive unit can in a familiar manner, be a slip drive unit in which a hydraulic motor which is acted upon by the pressure medium through rotation ducts rotates with the drum, or it can be differential drive unit in which a stationary hydraulic motor takes care of the differential rotary motion between the drum and the worm gear through a planetary differential gearing.

In these two known hydraulic systems, the fact that a relatively large pump must be installed to deliver the flow of the pressure medium which is required in borderline cases and that the hydraulic system cannot be used to bring the drum to speed or to control the rate of rotation of the drum are distinct disadvantageous shortcomings.

SUMMARY OF THE INVENTION

The principal object of the present invention is to use the same hydraulic system simultaneously accelerating and controlling the rotary motion of the drum and for feeding the pressure medium to the hydraulic motor of the differential drive unit, that is, the slip, or differential, drive unit.

To achieve this end, the decanter centrifuge of the above-mentioned type is characterized in that a hydrostatic coupling containing a pump or linkages driving a pump are connected between the main driving motor and the drum. A pressure line of the pump feeds the hydraulic motor of the differential drive unit with pressure medium.

The way the drive unit of the invention is built makes it unnecessary to provide a separate unit for the differential drive unit to feed the pressure medium. In addition, the effort and expenditure devoted to control purposes can be kept within limits since the torque/rate-of-rotation characteristics of the drive unit for the drum and the differential drive unit for the worm gear, and consequently their pressure and flow characteristics, too, harmonize almost ideally with one another. In the simplest case, a limitation of torque at the differential drive unit is produced simultaneously, for reasons of continuity, by an increase in the rate of rotation of the differential drive unit (a falling off of the frictional forces) and a reduction of the rate of rotation of the drum (a falling off of the centrifugal force). Furthermore, the hydrostatic coupling and the linkages-pump device can be used for the controlled bringing-to-speed of the decanter centrifuge in a conventional way, reducing the driving power equipment to be installed to an absolute minimum.

BRIEF DESCRIPTION OF THE DRAWINGS

FIG. 1 shows a schematic representation of a first embodiment with a slip drive unit for the worm gear of the decanter centrifuge and a hydrostatic coupling for its drum's drive unit according to the present invention.

FIG. 2 shows a schematic representation of a second embodiment with a planetary differential drive unit for the worm gear and a pump linkage for the drive unit for the drum according to the present invention.

FIG. 3 is a pressure-flow diagram of the drive unit for the drum and the differential drive unit.

FIG. 4 shows a schematic representation of a circuit with a two-way flow-regulator for the embodiments of FIGS. 1 and 2.

FIG. 5 shows a schematic representaion of an additional circuit with a pressure balance for the embodiments of FIGS. 1 and 4 and FIGS. 2 and 4.

DESCRIPTION OF THE PREFERRED EMBODIMENTS

The decanter centrifuge represented in FIGS. 1 and 2 has a drum 1 positioned and operatively arranged so that it can rotate and a worm gear 2 located within the drum and arranged so that it also can rotate. The worm gear has a shaft 3. The drum is driven by a main driving motor 5, an electric motor for example, by belts 4.

In the embodiment in FIG. 1, a slip drive unit 7 is provided as a differential drive unit for the worm gear 2. The slip drive unit 7 includes a hydraulic motor 8 associated with rotary ducts 9 for delivering and returning a pressure medium. As is shown in FIG. 1, the housing 10 of the hydraulic motor 8 is connected firmly with the drum 1, while the shaft 11 of the hydraulic motor 8 is connected firmly to the shaft 3 of the worm gear 2. The pressure medium is delivered to the rotary ducts 9 of the slip drive unit 7 through a pressure line 12 which has a pressure-medium connection 13 which constitutes the entrance to the slip drive unit 7, represented schematically. Return the pressure medium from the hydraulic motor 8 is carried out through the rotary ducts 9 to a storage container 14. Such an arrangement with a hydraulic motor capable of rotating for producing a differential rate of rotation for the worm gear of the decanter centrifuge is known from U.S. Pat. No. 3,923,241, for example.

In the embodiment shown in FIG. 2, a differential drive unit 17 is provided as a differential drive unit for the worm gear 2 and includes a stationary hydraulic motor 18 and planetary differential gearing 19 which is driven by it. The housing 20 of the differential gearing 19 is firmly connected to the drum 1, the primary shaft of the differential gearing being firmly connected to the shaft 21 of the hydraulic motor 18, and the output shaft of the differential gearing being firmly connected to the shaft 3 of the worm gear 2. Feeding the pressure medium to the hydraulic motor 18 takes place through a pressure line 22 which has a pressure-medium connection 23 which constitutes the entrance to the differential drive unit 17, represented schematically. As in the first embodiment, the pressure medium is returned from the hydraulic motor 18 to a storage container 24. Such an arrangement with a differential gearing driven by a stationary hydraulic motor for producing a differential rate of rotation for the worm gear of the decanter centrifuge is known from U.S. Pat. No. 3,734,399, for example.

Referring once again to the embodiment shown in FIG. 1, it can be seen from that figure that, between the main driving motor 5 and the belt drive 4 of the drum 1, a hydrostatic coupling which is designated as a unit with the number 27 is connected and which includes a coupling pump 28 and rotary ducts 29 for delivering and returning the pressure medium. Such a hydrostatic coupling is known from U.S. Pat. No. 3,896,912, for example. The drive shaft 30 of the hydrostatic coupling 27 is connected firmly to the shaft of the drive motor 5, while its drive shaft 31 drives the belts 4. An exhaust pipe 33 of the coupling pump 28 leads through the rotary ducts 29 into the storage container 14 for the pressure medium. While the coupling pump of the hydrostatic coupling known from U.S. Pat. No. 3,896,912 also is connected, on the pressure side, with the storage container for the pressure medium through a restrictor. In the present arrangement, a pressure line 34 of the coupling pump is connected with a pressure line 35 via the rotary ducts 29, and the pressure line 35 is provided with a pressure-medium connection 36 which constitutes the outlet of the coupling 27.

In the embodiment shown in FIG. 2, a pump linkage unit designated as a unit with the number 37 is connected between the main driving motor 5 and the belt drive 4 of the drum 1 which includes a pump 38 and a differential drive unit (gearing) 39. The drive shaft 40 of the differential drive unit 39 is firmly connected to the shaft of the main driving motor 5. The output shaft 41 of the differential drive unit 39 drives the belts 4. As is indicated in FIG. 2, the rotatable housing of the differential drive unit 39 is connected, so that it can rotate, with the drive shaft 42 of the pump 38. An exhaust pipe 43 of the pump 38 leads into the storage container 24 for the pressure medium. A pressure line 45 of the pump 38 has a pressure-medium connection 46 which constitutes the outlet of the unit 37.

To feed the hydraulic motor 8 or 18 of the differential drive unit 7 or 17 from the pressure line 35 or 45 of the pump 28 or 38 of the hydrostatic coupling 27 or the pump-linkage unit 37 with pressure medium in FIGS. 1 and 2 according to the invention, the pressure-medium connections 13 and 36 or 23 and 46 are connected with each other in a suitable manner which will be described in the following.

It should also be noted, in regard to the two different embodiments represented in FIGS. 1 and 2, that neither does the slip drive unit 7 of FIG. 1 differ essentially from the differential drive unit 17 of FIG. 2 nor does the hydrostatic coupling 27 of FIG. 1 differ essentially from the pump-linkage unit 37 of FIG. 2. In other words, the slip drive unit 7 can just as well be used together with the pump-linkage unit 37 and the differential drive unit 17 together with the hydrostatic coupling 27. The decisive factors in selecting such pairings might be only the cost of manufacturing at the time and the degree of effectiveness or advantage in controlling or adjusting which is obtained. Thus, the following explanations apply to all four possible pairings.

As was mentioned earlier, the torque/rate-of rotation characteristics of the drum drive unit and the differential drive unit of the worm gear are not in conflict with one another. Just as in the case of the differential drive unit, the torque/rate-of-rotation characteristic is almost hyperbolic in the case of the drum drive unit. As a consequence of the transposition of the torque and the rate-of-rotation of the drum drive unit by the hydrostatic coupling 27 in the embodiment shown in FIG. 1 or the equivalent pump-linkage unit 37 in the embodiment shown in FIG. 2, a similar course is taken by the corresponding pressure-flow characteristic of the drum drive unit at the outlet of the pump 28 or 38, that is at the pressure-medium connection 36 or 46. In FIG. 3, the relationship between pressure p and flow Q of the pressure medium is represented for the drum drive unit by a curve 48. From that it can be seen that, for example, a flow Q of the pressure medium which is so small as to seem to be disappearing corresponds to an extremely high pressure p at the pump outlet on the pressure side, i.e., a rigid coupling between the main driving motor S and the belt drive 4, which is required for the highest rate of rotation of the drum 1. On the other hand, the hydraulic differential drive unit requires the highest drive or pressure-medium pressure p, as is demonstrated by a curve 49 in FIG. 3 in the case of the smallest intake of pressure medium, that is, in the case of the smallest differential rate of rotation between the worm gear 2 and the drum 1. In this way, it is possible to connect the hydrostatic coupling 27 (FIG. 1) or the pump-linkage unit 37 (FIG. 2) hydraulically with the differential drive unit 7 or 17 by connecting the corresponding pressure-medium connections 13 and 36 (FIG. 1) or 23 and 46 (FIG. 2) with each other hydraulically. Consequently, that can take place without opposing a fundamental disadvantage consisting of characteristics of the drum and worm gear drive units which were inimical to the system to the advantage of the invenion of feeding the hydraulic coupling element, that is, the hydrostatic coupling 27 or the pump linkage unit 37 located between the main driving motor 5 and the belt drive 4 of the drum 1.

As can be seen from FIG. 3, however, the course of the two curves 48 and 49 is such that the possibility of instabilities cannot be excluded if there is a direct hydraulic connection of the pressure-medium connections 13 and 36 or 23 and 46 by a hose, for example. Therefore, it is advantageous to connect a regulator between the said pressure-medium connections or the coupling outlet and the input of the differential drive unit, which input functions to carry out a prescribed regulating of the torque at the differential drive unit by adjusting the corresponding differential rate of rotation. In carrying out this process, three different operating conditions can be distinguished, as set out in some detail below.

First, the torque requirement of the differential drive unit 7 or 17 corresponds to a pressure of the pressure medium that is smaller than the pressure available at the outlet of the hydrostatic coupling 27 or the pump-linkage unit 37, that is, at the pressure-media, connection 36 or 46. In other words for this case, the pressure p lies on the curve 49 in the shaded section bordered by the curve 48 in the diagram in FIG. 3.

Second, the torque requirement or the pressure requirement of the differential drive unit 7 or 17 exceeds the level of the coupling pressure available at the connection 36 or 46; however, the separation process carried out by the decanter centrifuge permits a reduction of the centrifugal force of the drum 1.

Third, as in the second case, the torque requirement or the pressure requirement of the differential drive unit 7 or 17 exceeds the level of the coupling pressure available at the connection 36 or 46; however, the separation process which is carried out does not permit a reduction of the centrifugal force of the drum 1.

In the following, simple embodiments of regulators for the said torque regulation at the differential drive unit are described for the operating conditions set out above.

For cases involving operating the first operating condition, it suffices to connect a simple two-way flow-control valve 51 (a known device) with an adjustable drain containing a pressure-control valve 52 and an adjustable metering diaphragm 53 between the connections 13 and 36 or 23 and 46, in accordance with FIG. 4. To adjust the metering diaphragm 53, that is, to present a nominal value for the flow-control valve, drive parameters, such as the pressure of the pressure medium, the flow of the pressure medium and the rate of rotation, or process parameters, such as the throughput, the drying substance and the turbidity of the material being centrifuged, can be made use of. Accordingly, in one case the adjustment of the metering diaphragm 53 can be accomplished mechanically-hydraulically, and this can be done advantageously with a valve arrangement in accordance with the teachings from U.S. Pat. No. 4,113,171, where the external control element, specifically a pin or the like, is connected to the adjusting element of the metering diaphragm 53, with the valve arrangement itself being exposed to the pressure at the connection 13 or 23. In the other case, the metering diaphragm 53 can be adjusted by a processor signal. As long as the pressure of the pressure medium required to generate the torque required by the differential drive unit 7 or 17 during operation is smaller than the pressure present at the pump 28 of the hydrostatic coupling 27 or that at the pump 38 of the pump linkage unit 39, the appropriate regulating of the differential drive unit is accomplished by the flow regulator 51.

To obtain the above-mentioned first operating condition, as the normal case, the pertinent pressure of the hydrostatic coupling 27 or the pump linkage unit 39 can be influenced by selecting an appropriate transmission ratio for the belt drive 4 of the drum 1. This first operating condition can also be obtained, as the normal case, because an increase in pressure at the differential drive unit, which is indicated by the curve 49*a* in FIG. 3, usually goes along with an increase in pressure at the hydrostatic coupling or at the pump linkage unit of the drum drive unit, indicated by the curve 48*a* in FIG. 3, since the differential torque at the same time indicates increased centrifugal turnover by the drum's discharge apparatus.

The processes which take place in such normal operating condition can be described by means of the example which follows. Let it be assumed that one looks at the embodiment of FIG. 1 and that the two-way flow-control valve of FIG. 4 is connected between the connections 13 and 36 and that its adjustable metering diaphragm 53 is being controlled, depending upon the pressure of the pressure medium, as was described above, that is, by a valve arrangement in accordance with U.S. Pat. No. 4,113,171 which is not shown. Furthermore, let it be assumed that the frictional forces of the worm gear 2 increase as a result of the imposition of a greater burden by the material being centrifuged.

The increase in the worm gear 2's frictional forces results in an increase in the pressure of the pressure medium in the pressure line 22. As a result, the metering diaphragm 53 of the flow-control valve 51 makes an adjustment in the direction of a larger flow of pressure medium flowing from connection 36 to connection 13 to raise the differential rate of rotation of the worm gear 2. The greater flow of pressure medium results in a reduction of the rate of rotation of the drum 1 through the hydrostatic coupling, that is, a reduction of the centrifugal force which acts in the direction of a reduction of the frictional forces for the worm gear 2, that is, a limitation of the torque. As a result, a new operating condition with an increased differential rate of rotation and a reduced rate of rotation of the drum quickly makes its appearance.

The following additional measures can be taken to bring on the previously-mention second and third operating conditions, as well become apparent from the following text.

If the separating procedure which is carried out permits a reduction of the centrifugal force, the torque requirement or the pressure requirement of the differential drive unit can also be lowered by a reduction of the rate of rotation of the drum 1 while the differential rate of rotation remains the same, and that requirement will be lowered until it coincides with the pressure provided by the hydrostatic coupling or the pump linkage unit. For this purpose, a three-way flow-control valve is provided as a hydraulic linkage for the connections 13 and 36 or 23 and 46. An advantageous embodiment of such a three-way flow-control valve consists of attaching a pressure balance 55, which is represented schematically in FIG. 5, in addition to the two-way flow-control valve 51 shown in FIG. 4, to the connections 13 and 36 or 23 and 46, which two-way flow-control valve 51 has already been described and which is provided for the first operating condition in normal cases. Thus, the flow-control valve 51 serves as a metering element for the pressure balance 55, so that, depending upon the pressure between the connections 13 and 36 or 23 and 46, a variable proportion of flow of the pressure medium flows from the pump 28 or 38 to the storage container 14, or 24. As a result of an increase in the flow, the rate of rotation of the shaft 31 or 41, and consequently that of the drum, decreases, and the centrifugal force decreases correspondingly, so that the differential drive unit's torque requirement drops off.

However, if the separating procedure which is carried out does not permit a lowering of the centrifugal force when the torque or pressure requirement of the differential drive unit exceeds the available level of the pressure of the hydrostatic coupling or the pump-linkages unit, the amount of flow and pressure provided for the differential drive unit must be increased. That can be accomplished by means of a flow-controlled variable pump 56, which is indicated by dotted lines in FIGS. 1 and 2. Driving the adjustable pump 56 is accomplished by the driven shaft 31 of the hydrostatic coupling 27 (FIG. 1) or by the output shaft 41 of the differential gear 39 of the pump-linkage unit 37 (FIG. 2), that is, at a rate of rotation proportional to that of the drum 1. The pressure line 57 of the pump 56 is connected to the pressure line 35 or 45 of the hydrostatic coupling 27 of the pump-linkages unit 37. The two-way flow-control valve 51 in FIG. 4 which is provided for the normal case involving the first operation condition once again serves as a metering element which regulates the pump 56 since a manometric piston 58 which activate the pump 56's adjusting element 59 is also connected hydraulically with the connections 13 and 36 or 23 and 46.

The arrangement of the hydrostatic coupling 27 or the pump-linkages unit 37 according to the invention makes it possible to take other, special operating conditions into consideration because of their special characteristics. Thus it is possible, by simple means, to achieve an adjustable limitation of the torque when bringing the decanter centrifuge to speed by connecting a relief-valve jet 61 to the pressure line 35 of the pump 28 of the hydrostatic coupling 27 of FIG. 1 or the pressure line 45 of the pump 38 of the pump-linkages unit 37 of FIG. 2. Furthermore, the possibility of a disengaging clutch not shown in the diagram exists which consists of connecting an additional by-pass pilot valve to the pressure line 35 or 45 which can connect the pressure line 35 or 45 to the storage container 14 or 24. On the other hand, a momentary loss of flow can be bridged over by means of pressure-medium reservoirs which can be provided. It is also possible to bring about an accelerated retarding of the drum while maintaining the differential rate of rotation by means of the flow-control pump 56 represented in FIGS. 1 and 2, while the main driving motor 5 is to serve as a brake in case the measures applicable to the first and second operating conditions are to be taken in accordance with FIG. 4 or FIGS. 4 and 5. Finally, the pump 28 of the hydrostatic coupling 27 or the pump 38 of the pump-linkages unit 37 can be adjustable pumps, as is indicated in FIGS. 1 and 2, where an element 63 for adjusting the pumps 28 and 38, respectively, is shown with dotted lines. Then the pump can either work alone or together with the afore-mentioned regulators 51, 55 and 56 in the process of controlling the differential rate of rotation and the rate of rotation of the drum.

It is to be understood that the foregoing, as well as the accompanying drawings, relates to embodiments given by way of example, not by way of limitation. Numerous other embodiments and variants are possible, without departing from the spirit and scope of the invention, its scope being defined by the appended claims.

What is claimed is:

1. A decanter centrifuge comprising a drum, a drum hydraulic drive motor, means operatively drivingly connecting said drum and said drum drive motor, a worm gear rotatably mounted inside said drum, a differential drive unit comprising a worm gear hydraulic motor for driving said worm gear at a rate of rotation different from that of the drum, a coupling pump operatively arranged in the power train between said worm gear drive motor and said worm gear, and a single pressure feed system feeding both said drum drive motor and said coupling pump of said differential drive unit with pressurized fluid.

2. The combination of claim 1, wherein said differential drive unit comprises a tandem arrangement of said worm gear drive motor, said coupling pump, and mechanical drive means for said worm gear in series.

3. The combination of claim 1, wherein said differential drive unit comprises a mechanical differential drive gear linkage interposed between, on one hand, mechanical drive means for said worm gear and, on the other hand, said worm gear drive motor and said coupling pump.

4. The combination of any one of claims 1 to 3, wherein said single pressure feed system comprises a pressure line interposed between said coupling pump and said drum drive motor, and at least one flow control element in said pressure line to control the differential rate of rotation of said worm gear with respect to that of said drum.

5. The combination of claim 4, including means for deriving a nominal value for said at least one flow-control element from drive parameters, that is, from pressure, rotation rate and flow of pressurized fluid.

6. The combination of claim 4, including means for deriving a nominal value for said at least one flow control element from process parameters, that is, throughput, drying substance and turbidity.

7. The combination of claim 4, including means for deriving a nominal value for said at least one flow-control element from at least one of: drive parameters, that is, from pressure, rotation rate and flow of medium; and from process parameters, that is, throughput, drying substance, and turbidity; wherein said flow-control elements is a two-way flow-control valve containing a flow-control diaphragm and is located in said pressure line to adjust said differential rate of rotation in accordance with said nominal-value adjustment of said flow-control diaphragm and also correspondingly to control the rate of rotation of said drum.

8. The combination of claim 7, wherein said single pressure feed system comprises a flow-controlled, variable pump driven at a rate proportional to the rate of rotation of said drum and whose feed line leads into said pressure line to increase the flow and pressure of the pressure fluid available for said differential drive unit, and said two-way flow-control valve serving as a metering element for adjusting said flow-controlled, variable pump.

9. The combination of claim 7, wherein a pressure balance which throttles an outlet of said pressure line is located on said pressure line to limit the differential torque by reducing the centrifugal force, and said two-way, flow-control valve serving as a metering element for adjusting said pressure balance.

10. The combination of any of claims 1 to 3, and wherein said coupling pump is adjustable, whereby said coupling pump can assist in regulating said differential rate of rotation.

* * * * *